US006264132B1

(12) United States Patent
Menz et al.

(10) Patent No.: US 6,264,132 B1
(45) Date of Patent: Jul. 24, 2001

(54) METHOD AND DEVICE FOR GRASPING PART OF AN OUTER LAYER OF A STRIP OF MATERIAL ON A SUPPLY ROLL

(75) Inventors: Martin Günter Menz, Waldbüttelbrunn; Gerd Erich Stettner, Coswig; Franz Konrad Mezger, Lauda-Königshofen, all of (DE)

(73) Assignee: Koenig & Bauer Aktiengesellschaft, Wuerzburg (DE)

( * ) Notice: Subject to any disclaimer, the term of this patent is extended or adjusted under 35 U.S.C. 154(b) by 0 days.

(21) Appl. No.: 09/423,630

(22) PCT Filed: May 18, 1998

(86) PCT No.: PCT/DE98/01370

§ 371 Date: Nov. 16, 1999

§ 102(e) Date: Nov. 16, 1999

(87) PCT Pub. No.: WO98/52857

PCT Pub. Date: Nov. 26, 1998

(30) Foreign Application Priority Data

May 16, 1997 (DE) ..... 197 20 492

(51) Int. Cl.[7] ..... B65H 19/18

(52) U.S. Cl. ..... 242/555.2; 242/562.1; 83/155; 83/156; 83/924; 156/508

(58) Field of Search ..... 242/555.1, 555.2, 242/562, 562.1; 83/14, 155, 156, 649, 924; 156/508, 507

(56) References Cited

U.S. PATENT DOCUMENTS

| | | | |
|---|---|---|---|
| 5,169,082 | 12/1992 | Da Silva et al. | 242/58.1 |
| 5,386,751 | 2/1995 | Dylla et al. | 83/18 |
| 5,783,029 | 7/1998 | Stettner et al | 156/510 |

FOREIGN PATENT DOCUMENTS

| | | |
|---|---|---|
| 4212095 C1 | 8/1993 | (DE) . |
| 19540689 A1 | 11/1996 | (DE) . |
| 19540689 C2 | 11/1997 | (DE) . |
| 0475886 A1 | 7/1991 | (EP) . |

*Primary Examiner*—John Q. Nguyen
(74) *Attorney, Agent, or Firm*—Jones, Tullar & Cooper P.C.

(57) ABSTRACT

A pair of synchronously rotating draw-in devices are placed in contact with an outer layer of a web of material wrapped on a supply roll. The outer layer is pulled between the two draw-in devices. This pulled-in outer layer can them be conveyed to a separate processing station where it can be given a fresh end.

25 Claims, 3 Drawing Sheets

METHOD AND DEVICE FOR GRASPING PART OF AN OUTER LAYER OF A STRIP OF MATERIAL ON A SUPPLY ROLL

FIELD OF THE INVENTION

The present invention relates to a method and a device for grasping a part of an outer layer of a material on a supply roll.

DESCRIPTION OF THE PRIOR ART

A method, as well as a device, is known from DE 42 12 095 C1, by means of which a suction strip is placed on the outer layer of a supply roll. The outer layer is lifted by this suction strip and is transversely cut. The start of a web of material formed by means of this is subsequently lifted and moved away.

DE 195 40 689 C2 shows a work carriage for preparing a paper web tip for a flying paper web roll change.

SUMMARY OF THE INVENTION

The object of the present invention is based on providing a method for grasping an outer layer of a web of material from a supply roll, as well as providing a device for grasping the outer layer of a supply roll.

In accordance with the present invention, this object is attained by using a pair of draw-in devices, such as draw-in rollers that are driven together. These draw-in rollers are brought into contact with the outer layer of material on the supply roll and draw the outer layer off the supply roll. Once the outer layer of material has been drawn into the draw-in device, it can be moved in a pre-determined path away from the supply roll.

The advantages which can be obtained by means of the present invention reside in particular, in that no suction lifters must be employed, and that with the device no matching to the width of the supply roll is necessary. The device of the present invention is matched to a maximally possible width of a supply roll, so that any narrower supply roll can also be processed. Regarding air permeability, basically any material, for example paper or textiles, can be processed. The position of the start of the web of material is of no importance for further processing.

BRIEF DESCRIPTION OF THE DRAWINGS

Several preferred embodiments of the present invention are represented in the drawings and will be explained in greater detail in what follows.

Shown are in.

DESCRIPTION OF THE PREFERRED EMBODIMENTS

Figure 1:
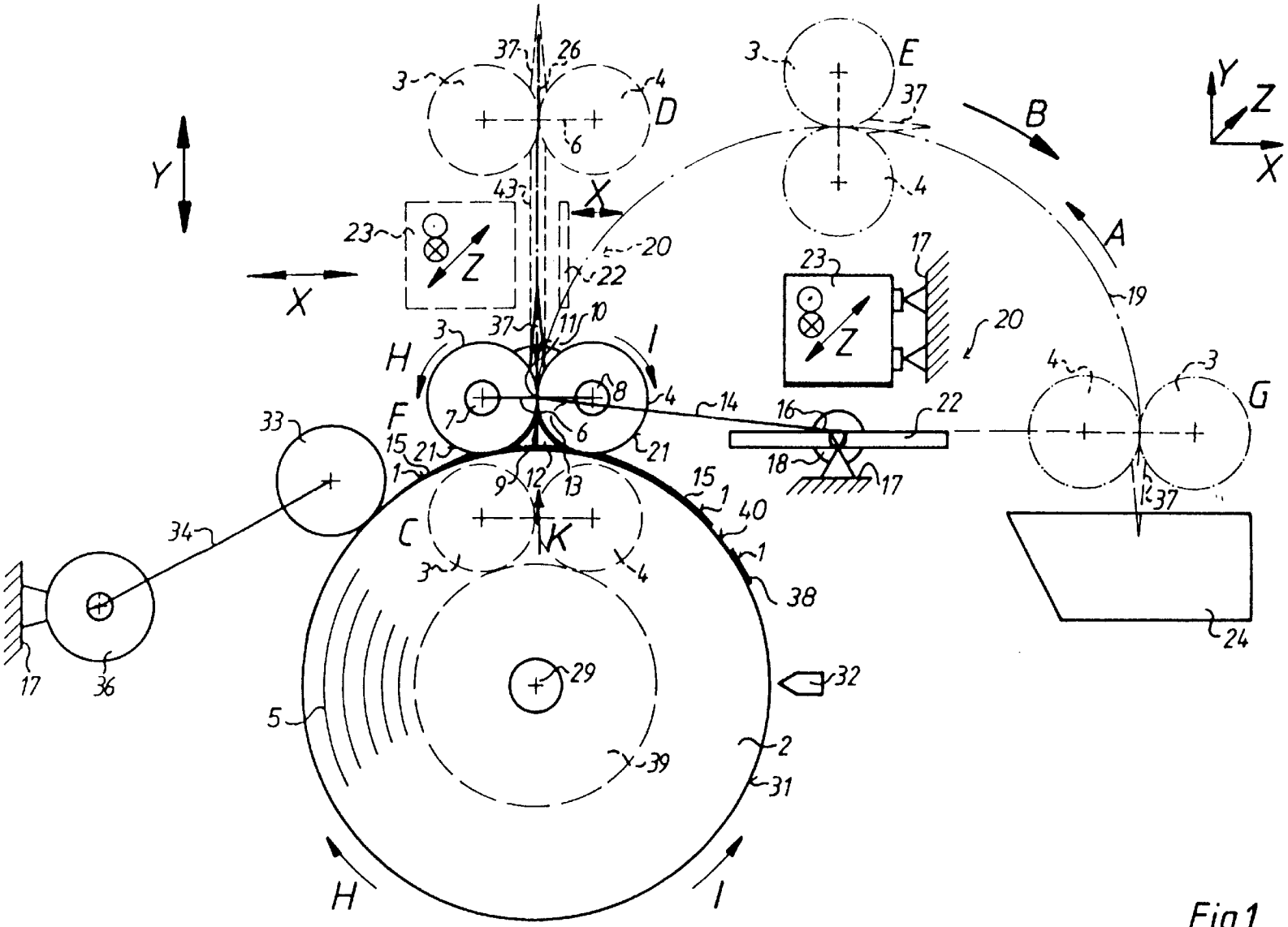
FIG. 1, a lateral side elevation view of a device in a schematic representation in accordance with first and second preferred embodiments, FIG. 2, a side elevation view of a device in a schematic representation in accordance with a third preferred embodiment and in, FIG. 3, a side elevation view of a device in a schematic representation in accordance with a fourth preferred embodiment.

A device for grasping an outer layer 1 or winding of a supply roll 2 of material, for example a supply roll, consists of two contacting gripping rollers or, forming a draw-in device rollers 3, 4 (draw-in), which draw-in rollers 3, 4 extend axis-parallel in respect to each other. They can be placed on the circumference 31 of the supply roll 2, as seen in FIG. 1.

The roller journals of the draw-in rollers 3, 4 are rotatably seated on both sides respectively in a two-armed lever 6. Both draw-in rollers 3, 4 are driven by motors 7, 8, for example asynchronous motors, so that the draw-in rollers 3, 4 rotate along with them. By means of this, an inlet wedge 9 is generated on a supply roll 2. The outlet wedge 10 lies opposite to inlet wedge 9.

It is also possible to embody the first draw-in roller 3 or 4 without its own motor drive and to place it into contact with the second motor-driven draw-in roller 4 or 3. With this, the draw-in roller 3 would be driven by friction. In this case, the first draw-in roller 3 turns in the unrolling direction H, and the second draw-in roller 4 rotates, following the direction of rotation of the first draw-in roller 3 and in the winding direction I of the supply roll 2.

A drive by traction means would also be possible.

The two-armed levers 6 can be pivoted around a pivot shaft 11, which is arranged at the first end 13 between two pivot arms 14 extending parallel with each other. A gear motor 12 is used for pivoting the two-armed levers 6. This gear motor 12 is arranged, fixed against twisting, on the first end 13 on one of the pivot arms 14.

The second ends 16 of the pivot arms 14 are respectively pivotably seated in a bearing 17, fixed in place on the machine frame. The pivot arms 14 can be pivoted by means of a gear motor 18, fixed in place on the machine frame. In the process, the draw-in rollers 3, 4 move on a curved path 19, shown in dashed lines in FIG. 1, for example on a circular path. The elements 18, 14, 6, 7, 8 are part of a pivot drive.

It is also possible to rotate the two-armed lever 6 by the use of a work cylinder, not specifically represented, which work cylinder is hingedly supported on the first end 13 of the pivot arm 14. The work cylinder can also be used to press the draw-in rollers 3, 4 against the supply roll 2. Moreover, the two-armed lever 6 can also be designed as a one-armed lever.

The draw-in rollers 3, 4 are made of a material with a high coefficient of friction, for example of a rubber-elastic material of a hardness of 50 Shore A, for example.

It is essential for the present invention, that at least the friction number $\mu$G1 for the sliding friction between the material of the web 5 of material, for example paper, and the surface of the shell or cover 21 of the draw-in means 3, 4 is greater than either the friction number $\mu$H2 for the static friction, and the friction number $\mu$G2 for the sliding friction of the end part 38 of the outer winding or layer 1 of the supply roll 2 on its winding or layer 40 directly below it.

The draw-in means device 3, 4 such as, for example the draw-in rollers 3, 4, therefore have a shell or outer cover 21 with a high friction number for sliding friction $\mu$G1 with the outer layer 1 of the web 5 of material, for example between 1.0 and 1.7, or greater.

This is achieved, for example, by the type of the rubber mixture or of the polish or roughness of the shell or outer cover 21.

The friction numbers for paper on paper are approximately 0.25 for the static friction $\mu$H2, and approximately 0.2 for the sliding friction $\mu$G2.

The rubber can extend over the entire shell or cover surface, or along the entire circumference of the draw-in rollers 3, 4, or only over individual sections of the shell or cover 21. In sections means, that the rubber of a high coefficient of friction is arranged, for example, in strips along the circumference of the cover 21, or in strips in the axial direction of the draw-in rollers 3, 4, and alternates with a material of a lesser coefficient of friction.

A further possibility for embodying the draw-in device 3, 4 lies in employing two touching, driven endless conveyor belts, which belts, or respectively their surfaces, are made of the aforementioned rubber-elastic material.

Another possibility for embodying the draw-in device 3, 4 consists in that the shells or covers 21 of the draw-in rollers 3, 4 have radial bores, and the draw-in rollers 3, 4 can be charged with suction air.

As alternative to the draw-in rollers 3, 4, which can be charged with suction air, endless conveyor belts which have holes can also be used as the draw-in device 3, 4. With their facing surfaces, the conveyor belts are each conducted over a suction box having slits or elongated holes, so that at least half of the holes located in the area of the elongated holes respectively correspond with the elongated holes for letting air pass through.

Finally, the draw-in device 3, 4 embodied as draw-in rollers or as conveyor belts can be designed so that they can be electrostatically charged, for example from a high voltage d.c. current source. In this case, the first draw-in device 3 is connected to a negative pole, and the second draw-in device 4 is connected to a positive pole, or vice versa.

In connection with the aforementioned draw-in device 3, 4, which can be pneumatically or electrostatically charged, it is essential that the holding forces of the draw-in device 3, 4 be greater than the forces of the outer layer 1 of the web 5 of material resulting from the static friction $\mu$H2 or the sliding friction $\mu$G2.

A processing station 20 is arranged within the curved path 19 of travel of the draw-in devices 3, 4, as may also be seen in FIG 1.

This processing station 20 consists, for example, of a height-adjustable table 22. A work carriage 23, which can be moved back and forth, is arranged in the axis-parallel direction Z in respect to the supply roll 2 above the table 22. The work carriage 23 can be moved, for example, on cross bars fixed in place. The work carriage 23 takes up a position of rest, for example, outside of the width of the supply roll 2.

A waste receptacle 24 is provided below an end position G of the supply roll 2.

A height-adjustable device for driving the supply roll 2 is provided below a grasping position F. The drive is provided, for example, by means of spreading cones, or support rollers, not specifically represented. An axis of rotation 29 of the supply roll 2 is located in the vertical direction Y underneath the inlet wedge 9 of the draw-in rollers 3, 4.

The supply roll 2 can be rotated in the winding direction I, as well as in the unwinding direction H.

A transverse cutting device 32, which is known per se, is provided in the vicinity of the circumference 31 of the supply roll 2. It is used to cut open the transport packaging of a supply roll 2.

A pressure roller 33, which can be placed against the circumference 21 of the supply roll 2, is arranged upstream of the first draw-in roller 3, viewed in the unwinding direction H of the supply roll 2. It has a shell or cover consisting of a material, which is a so-called anti-adhesive material, for example a silicon-containing, or Teflon-containing material. As represented in FIG. 1, the pressure roller 33 is guided by means of pivot arms 34, which are seated, fixed in place on the machine, and which can be pivoted by means of a motor 36.

It is also possible to arrange the pressure roller 33 on an extension, not represented, of the two-armed lever 6.

A method for grasping an outer layer or winding 1 of a supply roll 2 proceeds as follows:

The draw-in devices for example the draw-in rollers 3, 4, and the supply roll 2 can be relatively moved toward each other. This can take place by only the movement of the supply roll 2, or only the move of the draw-in rollers 3, 4, or by a mutual movement of the supply roll 2, as well as the draw-in rollers 3, 4.

After the draw-in rollers 3, 4 and the outer layer or winding 1 of the supply roll 2 have come into contact in the grasping position F, i.e. after the draw-in device 3, 4 have been placed on the outer layer 1, portions, parts 15 of the outer layer 1 are grasped by the draw-in rollers 3, 4 moving together in the draw-in direction of rotation K. The supply roll 2 rotates in the unwinding direction H. Based on the different coefficients of friction of the outer layer 1, of the web material 5, and the draw-in rollers 3, 4 rotating along together, the outer layer 1 is pulled from the direction of the temporary end 38 of the outer winding 1, as well as from the opposite direction as material parts 15, into the inlet wedge 9 and the outlet wedge 10. The formation, or completion of the formation of a loop 37 of web material located in the outlet wedge 10 is reported by sensors, not specifically represented. The draw-in rollers 3, 4 come to a stop, the pressure roller 33 is pushed against the supply roll 2, if necessary, and the draw-in rollers 3, 4 transport the loop 37 of web material clamped between the draw-in rollers 3, 4 to a processing station 20.

In the process, the draw-in devices, for example the draw-in rollers 3, 4, move along a straight line or a curved path. The movement path can take place on a straight line 26, 27 in the radial direction Y, T in relation to the axis of rotation 29 of the supply roll 2, or on a differently designed curved path 19 in relation to the outer layer or winding 1 of the supply roll. The curved path 19 can be designed to be circular, elliptical, etc.

The movement of the draw-in means 3, 4—along with the preliminary material start 38 passes the "work place" of the processing station 20. The processing station 20 has, for example, a work carriage 23 with the devices for transverse cutting of the web 5 of material, for the application of adhesive labels, a transverse glueing device and the like, as well as a work table 22. There are now the following options:

1. The draw-in devices 3, 4 pass through the "work place" of the processing station 20. In this case, the work carriage 23 and the work table 22 have been moved out of the area of the "work place". This can take place by longitudinal displacement along the longitudinal axes Z of the draw-in devices 3, 4, or vertically or perpendicularly in the direction X in respect to the longitudinal axes of the draw-in devices 3, 4 the direction Z. After passing the "work place", they are stopped. Thereafter the work carriage 23 and the work table 22 move in such a way, that the web 5 of material rests on the work table 22.

2. The draw-in devices 3, 4 pass through the "work place" along a curved path 19 on their way into a final or work position G. In the course of this, the web 5 of material loosens. The web 5 of material is tightened over the work table 22 by the continued rotation of the draw-in devices 3, 4. Subsequently, the work carriage 23 forms a "fresh" start of the material web or a new material web tip by a movement above the work table 22. This can occur by devices of transverse cutting of the web 5 of material, by the application of adhesive strips and adhesive labels. In the course of this, the work carriage 23 moves back and forth, for example from a position outside of the width of the supply roll 2, in the axial direction Z of the supply roll 2. The freshly created start of the material web is placed on the supply roll 2 in the winding direction I by rotating the supply roll 2, and is pressed against it, for example by devices of the pressure roller 33. Waste material being created is conducted into the waste receptacle 24 by continuing the rotation of the draw-in devices 3, 4.

It is, of course also possible to bring the draw-in rollers 3, 4 into a grasping position F, as shown in FIG. 1 on a supply roll 39 of small diameter in order to form a fresh start of the outer layer of the supply roll 39.

Figure 2:
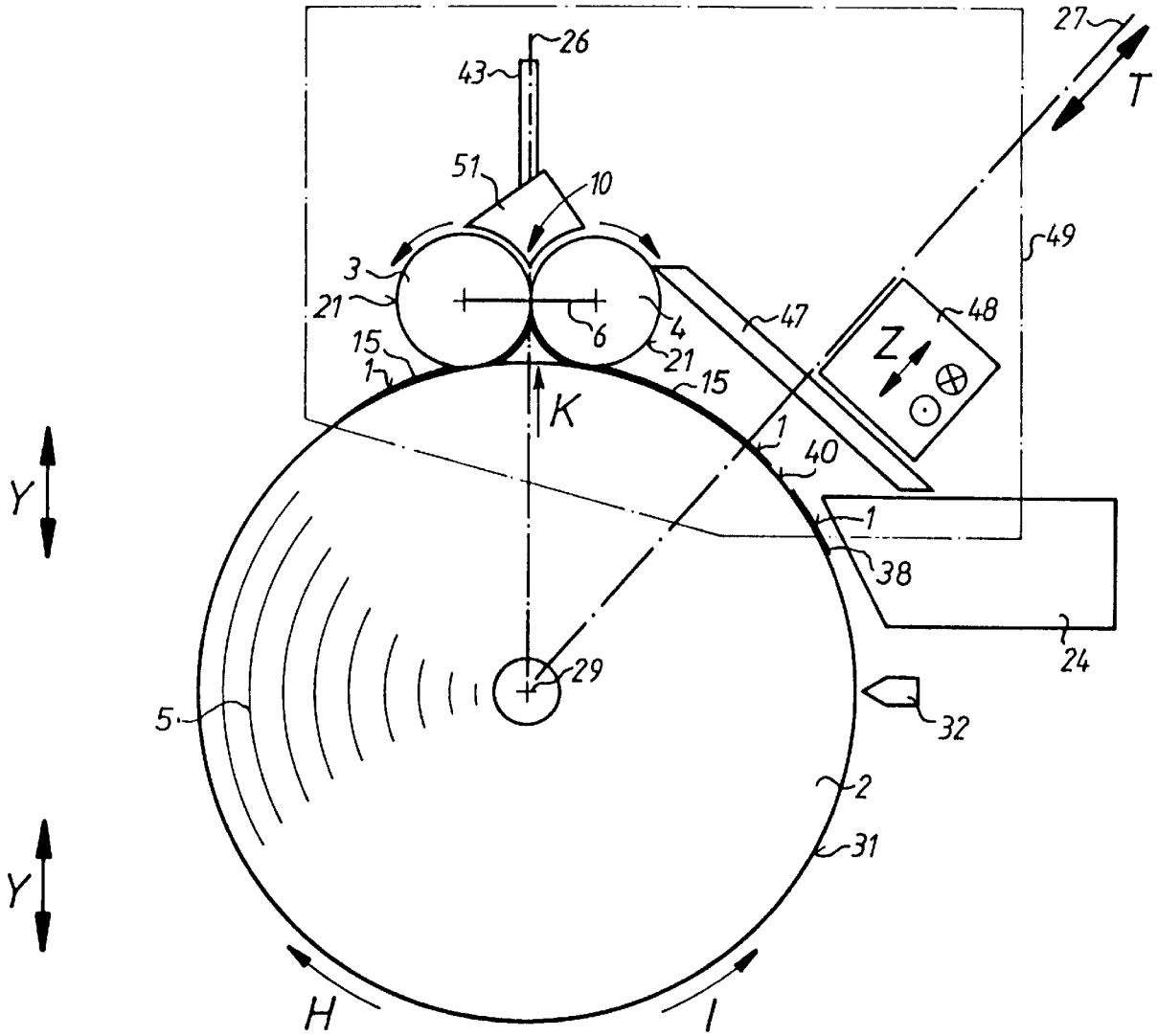

In accordance with a third preferred embodiment as seen in FIG. 2, the draw-in device, for example the draw-in rollers 3, 4, together with the clamped web 5 of material, are not moved along a path such as a straight line or curve. Next to a draw-in roller, for example the second one 4, an obliquely downwardly extending table 47, as well as a working carriage displaceable in an axis-parallel direction Z over the table 47, are arranged in a common component 49. A paper guide device 51 is arranged in the outlet wedge 10 of the draw-in roller 3, 4, which paper guide device 51 guides a paper web loop 37 drawn between the draw-in rollers 3, 4 to the table 22 via one, for example the second, draw-in roller 4.

In order to bring the component 49 with the draw-in devices, for example the draw-in rollers 3, 4, into contact with the supply roll 2, the latter can be moved up and down in the vertical direction Y, or respectively back and forth in the horizontal direction X by devices of a linear drive 43.

It would also be possible to leave the table 47, as well as the component 49, in the radial direction T at a fixed distance from the supply roll 2, and to only displace the draw-in rollers 3, 4 in the vertical direction Y, or also in the horizontal direction X, by devices of a linear drive 43.

It is furthermore possible to turn the entire component 49 in a clockwise direction B, for example by an angle of approximately 45°, so that the straight line 26 of the linear drive 43 extends in the radial direction T—approximately 45° removed from the Y-axis in the 1st quadrant of the right-angled coordinate system—congruently with the straight line 27.

Therefore the component 49 would be displaced from its position in the 2nd and 1st quadrants into a position in the 1st and 4th quadrants of the right-angled coordinate system. Then the component 49 would be movable back and forth in the radial direction T in respect to the supply roll 2.

Finally, it is also possible to install the component 49 fixed in place and to additionally move the paper web roll 2 in the vertical Y-direction back and forth, for example by devices of a lifting device.

Figure 3:
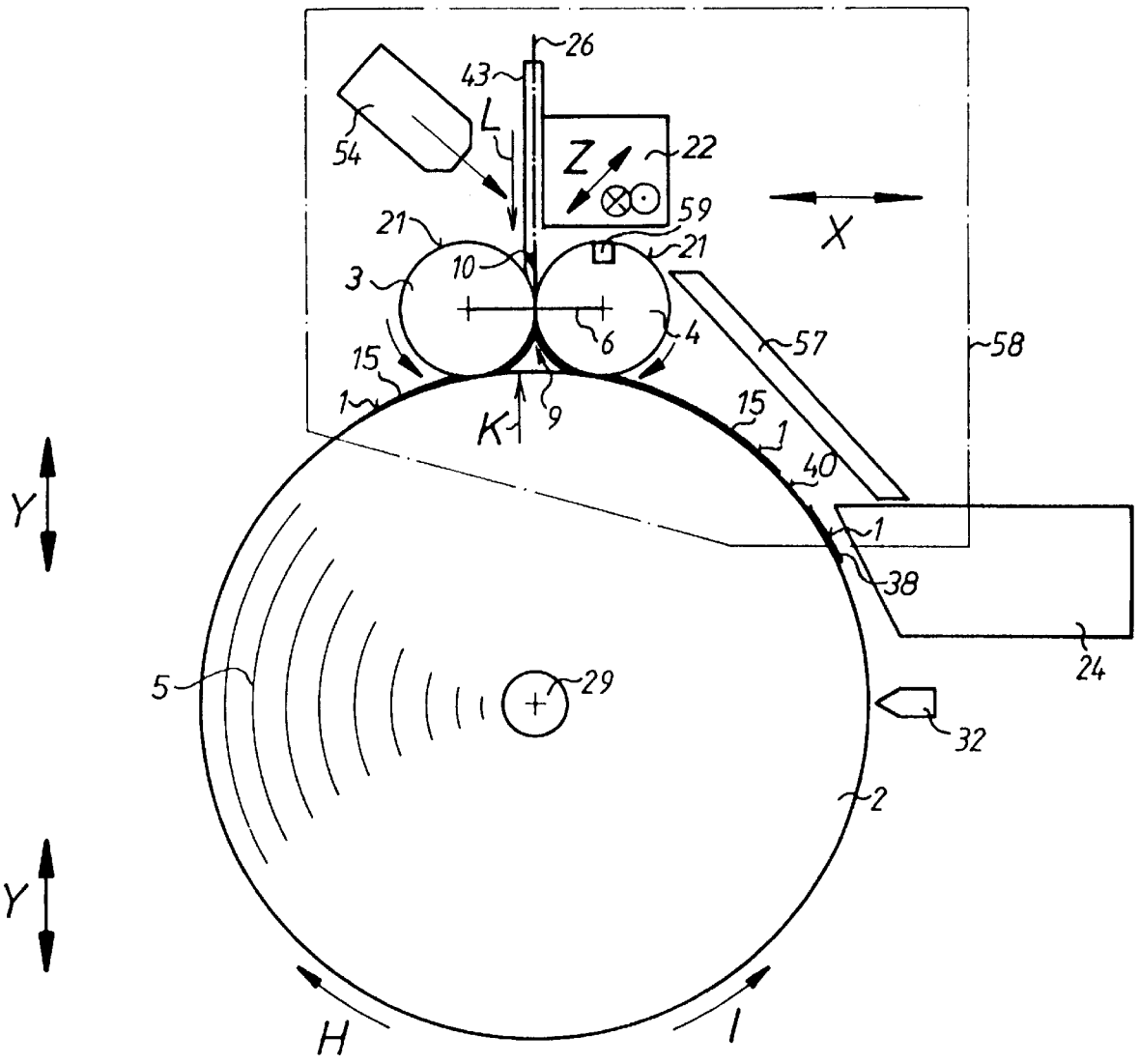

With the fourth preferred embodiment, which is shown in FIG. 3, in addition to what has been described above, there is provided a paper guide device 54 which is directed into the outlet wedge 10, as well as onto the second draw-in roller 4 and which acts, or example, pneumatically in the manner of a nozzle strip, and a work carriage 23 arranged above the paper guide device 54 and, for example, matching the surface which faces away from the supply roll 2 of the curvature of the second draw-in roller 4. The paper guide device 54, and the work carriage 23 are arranged in a common component. On its side facing the draw-in roller 4, the work carriage 23 can also be embodied straight. The work carriage 23 is arranged above or next to the draw-in roller 3 or 4. Furthermore, a waste removal device 57, following the second draw-in roller 4 and extending obliquely downward, is a part of the component 58.

One, for example the second, draw-in roller 4 has a counter-cutting strip 59 extending in the axis-parallel direction on its surface, which can be exactly positioned in respect to the work carriage 23.

The component 58 can be moved back and forth in the vertical Y-direction by devices of a linear drive 43 can be brought toward a rotatable and drivable supply roll 2.

The outer layer 1 of the supply roll 2 is pulled into a paper web loop, not specifically represented, by devices of the draw-in rollers 3, 4, which are in the work position. The supply roll 2 is rotated in the unwinding direction H in the course of this movement of the outer layer. A pressure roller 33 in accordance with FIG. 1 can also be placed against the supply roll 2. The outer layer 1 of the supply roll 2 is pulled between the draw-in rollers 3, 4, and is guided in the outlet wedge 10 onto the surface of the second draw-in roller 4 by devices of the paper guide device 54. Because of its back-and-forth movement guided in the axis-parallel Z-direction, the work carriage 23 provides the completion of a fresh paper web start. Here, the curved surface of the draw-in roller 4 is used as the work table. Following the completion of the fresh material web start, the supply roll 2 is rotated back in the winding direction I, and the fresh start is fixed in place on the supply roll 2.

The surface of the draw-in rollers 3, 4 is provided with a soft material coated with an anti-adhesive layer.

There is also the possibility of keeping the component 58 in its fixed position, and of giving the supply roll 2 only a lifting movement in the vertical direction Y in addition to the rotating movement.

The draw-in devices 3, 4 are in operative connection with each other. This means that the oppositely located draw-in devices 3, 4 can touch each other, or a gap can be provided between them. In this case the gap has sufficient dimensions, so that a web 5 or 1 of material, or respectively a loop 37 of web material, can be drawn in.

While preferred embodiments of a method and device for grasping pail of an outer layer of a strip of material on a supply web in accordance with the present invention have been set forth fully and completely hereinabove, it will be apparent to one of skill in the art that a number of changes in, for example, the drive for the supply roll, the type of printing press with which the supply roll may be used, and the like could be made without departing from the true spilit and scope of the present invention which is accordingly to be limited only by the following claims.

What is claimed is:

1. A method for grasping an outer layer of a web of material on a supply roll including:

providing two cooperating web draw-in devices;

driving said two web draw-in devices together;

moving said two web draw-in devices into contact with the outer layer of the web of material;

grasping parts of the outer layer between the two web draw-in devices and pulling the outer layer of the web of material between the two web draw-in devices; and moving the outer layer of the web of material along a pre-determined path away from the supply roll.

2. The method of claim 1 further including providing a processing station and bringing the outer layer of the web of material to said processing station and treating the outer layer of the web of material in said processing station.

3. A device for grasping a part of an outer layer of a web of material on a supply roll comprising:

two cooperating web draw-in devices;

means for driving said two cooperating web draw-in devices together; and means for moving said two cooperating web draw-in devices into operative cooperation with the outer layer of a web of material on a supply roll and grasping parts of the outer layer between the two web draw-in devices and pulling the outer layer of the web of material between the two web draw-in devices and moving the outer layer of the web of material along a pre-determined path away from the supply roll.

4. The device of claim 3 wherein said web draw-in devices and the supply roll are moveable in relation to each other.

5. The device of claim 3 wherein said web draw-in devices are two driven draw-in rollers, said two draw-in rollers being in axis-parallel cooperation.

6. The device of claim 5 wherein at least one of said draw-in rollers has a counter-cutting strip on the surface.

7. The device of claim 6 further including a work carriage positioned against said draw-in roller with said counter-cutting strip.

8. The device of claim 6 wherein said draw-in roller with said counter-cutting strip is a work place.

9. The device of claim 3 wherein said web draw-in devices include a plurality of driven rollers in operative connection with each other.

10. The device of claim 9 wherein said rollers are suction rollers.

11. The device of claim 9 wherein said rollers are electrostatically chargeable rollers.

12. The device of claim 3 wherein said web draw-in devices include two driven endless conveyor belts which are in operative contact with each other.

13. The device of claim 12 wherein said belts are suction belts.

14. The device of claim 12 wherein said belts are electrostatically chargeable belts.

15. The device of claim 3 wherein said two cooperating web draw-in devices touch each other.

16. The device of claim 3 wherein said two cooperating web draw-in devices are spaced apart from each other.

17. The device of claim 3 wherein each of said two web draw-in devices has a cover, said cover and the outer layer of a web of material having a sliding coefficient of friction greater than a sliding coefficient of function between the outer layer of a web of material and an underlying layer of a web of material on the supply roll.

18. The device of claim 17 wherein a surface of said cover of the two draw in devices is a rubber-elastic material.

19. The device of claim 3 further including a processing station provided on said pre-determined path.

20. The device of claim 19 wherein said processing station includes a table and a work carriage.

21. The device of claim 20 wherein said processing station includes a work carriage, said work carriage being moveable parallel to said work table and also transverse to said web draw-in devices.

22. The device of claim 19 wherein said processing station provides a fresh material web start on the outer layer of the web of material.

23. The device of claim 19 wherein said processing station includes a device for transversely cutting the web of material.

24. The device of claim 19 wherein said processing station includes devices for applying an adhesive to the outer layer of the web of material.

25. The device of claim 19 wherein said processing station includes devices for applying adhesive labels to the outer layer of the web of material.

* * * * *